US006015273A

United States Patent [19]

Hannagan et al.

[11] Patent Number: 6,015,273

[45] Date of Patent: Jan. 18, 2000

[54] ELECTROMAGNETIC RECIPROCATING COMPRESSOR WITH SPRING ASSEMBLY MOUNTED AROUND PISTON

[75] Inventors: Angus Patrick Douglas Hannagan, Waterlooville; Michael Alan McGrath, Hayling Island, both of United Kingdom

[73] Assignee: Pegasus Airwave Limited, Waterlooville, United Kingdom

[21] Appl. No.: 08/849,277

[22] PCT Filed: Dec. 8, 1995

[86] PCT No.: PCT/GB95/02901

§ 371 Date: Jul. 10, 1997

§ 102(e) Date: Jul. 10, 1997

[87] PCT Pub. No.: WO96/18037

PCT Pub. Date: Jun. 13, 1996

[30] Foreign Application Priority Data

Dec. 8, 1994 [GB] United Kingdom ..... 9424790

[51] Int. Cl.[7] ..... F04B 17/04

[52] U.S. Cl. ..... 417/417; 92/131; 92/165 R

[58] Field of Search ..... 417/417, 471, 417/552, 553; 92/155, 165 R, 131

[56] References Cited

U.S. PATENT DOCUMENTS

| | | | |
|---|---|---|---|
| 3,171,585 | 3/1965 | Gauss | 417/553 |
| 3,588,291 | 6/1971 | Corwen . | |
| 4,636,150 | 1/1987 | Falk et al. | 417/417 |
| 5,100,304 | 3/1992 | Osada . | |
| 5,275,542 | 1/1994 | Terauchi | 417/417 |
| 5,597,294 | 1/1997 | McGrath | 417/417 |
| 5,603,612 | 2/1997 | McGrath | 417/417 |
| 5,727,932 | 3/1998 | McGrath | 417/417 |

FOREIGN PATENT DOCUMENTS

| | | |
|---|---|---|
| 509660 | 10/1992 | European Pat. Off. . |
| 2219047 | 11/1989 | United Kingdom . |
| 2 241 287A | 8/1991 | United Kingdom . |
| 94 28306 | 12/1994 | WIPO . |
| WO 94/28307 | 12/1994 | WIPO . |
| WO 94/28308 | 12/1994 | WIPO . |

*Primary Examiner*—Charles G. Freay
*Attorney, Agent, or Firm*—Larson & Taylor

[57] ABSTRACT

An electromagnetic reciprocating compressor has a body (1, 2), a piston (10) reciprocating in the body, and an electromagnetic drive (22, 23, 24) for the piston. The piston has a piston head (11) which slides in a cylinder (12) in the body to effect compression of fluid in the cylinder during operation of the compressor and, axially spaced from the piston head, a piston guide member (13) slidingly movable on a guide surface (14) provided by the body. The compressor has a compression spring arrangement (20) comprising at least one helical compression spring (20*a, b*) acting to drive the piston axially. The spring (20*a, b*) is mounted around the piston and is at least partly located within the cylinder during at least part of the piston stroke but is outside the working volume of fluid undergoing compression.

9 Claims, 2 Drawing Sheets

Figure 1:
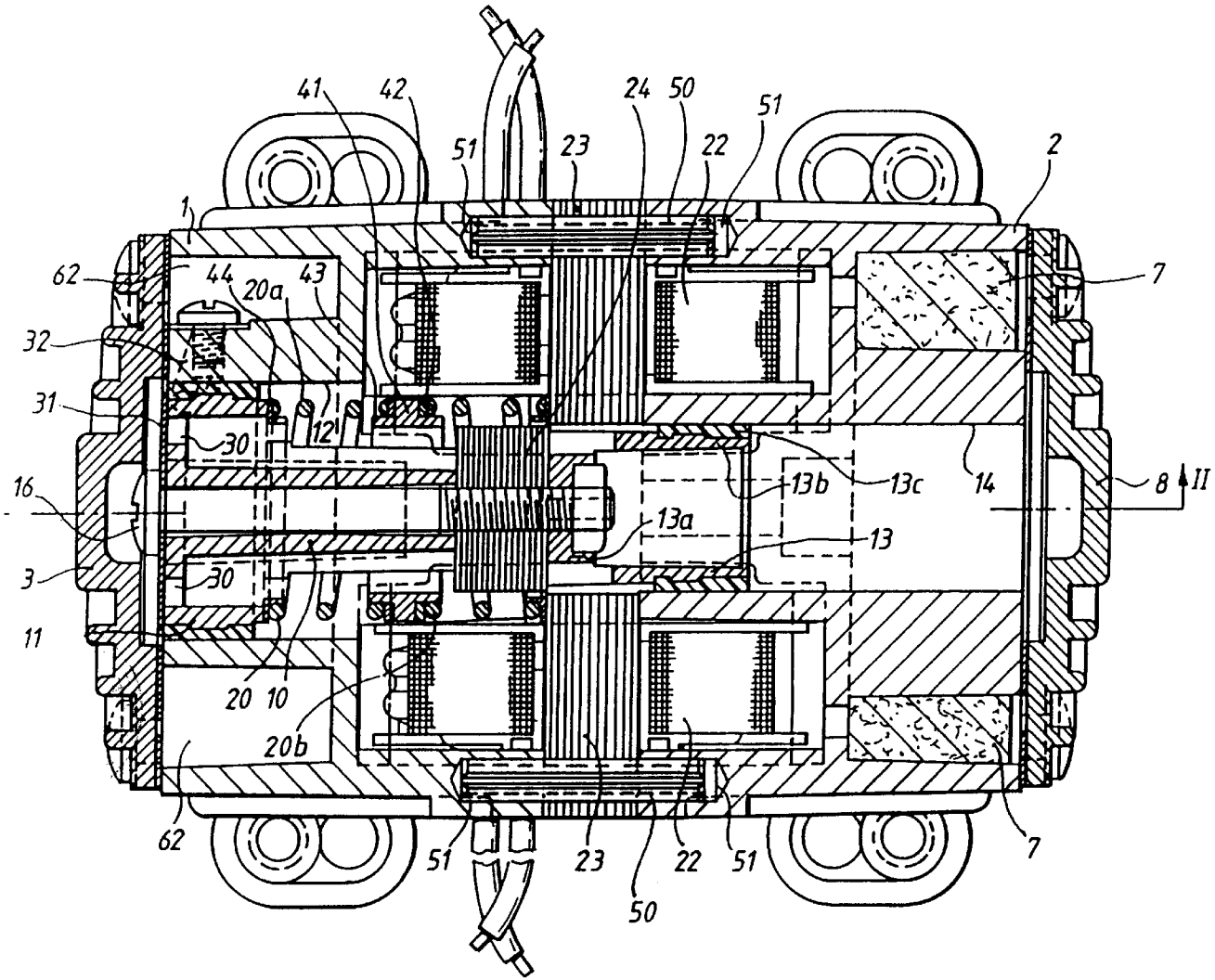

ELECTROMAGNETIC RECIPROCATING COMPRESSOR WITH SPRING ASSEMBLY MOUNTED AROUND PISTON

TECHNICAL FIELD

This invention relates to electromagnetic reciprocating compressors or pumps, particularly compressors for pumping gas such as air. Such devices can also act as vacuum pumps, but the term "compressor" will be used generally in this specification for convenience.

BACKGROUND TO THE INVENTION

International patent applications PCT/GB94/01193, PCT/GB94/01194, PCT/GB94/01195, published as WO 94/28306, WO 94/28307 and WO 94/28308 respectively, and deriving from one of the inventors of the present application, describe a compressor which provides a number of improvements in the art. Reference should be made to these applications, hereinafter called "the earlier applications", for background discussion of such compressors and for details of the compressor described in those applications.

The present invention seeks to provide some modification and improvement of the compressor of the earlier applications. Particularly the present invention is concerned with the problem of reducing wear, particularly uneven wear, of the sliding surfaces of the reciprocating piston. In addition the invention is concerned with improving the ease of manufacture and assembly of the compressor.

It is well known in electromagnetic reciprocating compressors to provide a helical compression spring which causes the return stroke of the piston. In the earlier applications, particularly WO 94/28306, it is described how inherent defects in the compression spring or misalignment in its mounting can cause the spring to apply unsymmetric force to the piston, resulting in uneven wear.

It is known from GB-A-2241287 in a double-acting electromagnetic compressor, in which the piston alternately compresses gas in two opposed working chambers, to mount two compression springs which restore the piston to a neutral position inside the respective working chambers.

It is known from EP-A-509660 to locate a return spring around the piston and partly in the cylinder of the compressor outside the working chamber of the cylinder.

SUMMARY OF THE INVENTION

According to the present invention in one aspect there is provided an electromagnetic reciprocating compressor having a body, a piston reciprocating in the body, and an electromagnetic drive for the piston, the piston having a piston head which slides in a cylinder in the body to effect compression of fluid in the cylinder during operation of the compressor and, axially spaced from the piston head, a piston guide member slidingly movable on a piston guide surface provided by the body, the piston carrying an armature forming part of said electromagnetic drive, the compressor having a compression spring arrangement comprising at least one helical compression spring acting to drive the piston axially, which spring is mounted around the piston and is at least partly located within the cylinder during at least part of the piston stroke but is outside the working volume of fluid undergoing compression, characterised in that, for replacement or maintenance, the piston including the armature and the piston guide member is removable from the body through the end of the cylinder remote from the piston guide surface. Typically therefore the compression spring acts at one end on a surface of the piston which is outside the working chamber, in which the fluid is compressed.

The invention is especially applicable to a single-acting compressor, i.e. one in which there is only one working chamber in which fluid is compressed by the action of the piston and the piston has a single piston head surface which faces the working chamber.

Preferably the compression spring acts at one end upon a rear face of the piston head.

Preferably the or each compression spring is freely rotatable at at least one end relative to the piston. There may be a single compression spring, but preferably two such springs are employed in the spring arrangement, with at least one of the springs being at least partly in the cylinder. Most preferably there are a pair of helical springs of opposite helical coiling sense acting in series and with a free bearing member between them, as described in the earlier applications. In the present invention this free bearing member may be an annular member surrounding the piston with clearance from the piston.

Preferably, as in the earlier applications, each helical spring is mounted at one end on the bearing so as to be rotatable relative to the bearing, for example by the interposition of a low friction material.

The opposite end of the spring arrangement from the end acting upon the piston head may be located on a mounting member which bears on a lamination stack providing a stator of the electromagnetic drive of the compressor.

Advantages which can be provided by the invention in this first aspect are a reduced overall length of the compressor, because the return spring for the piston is not provided between the piston and a rear end of the compressor body as is conventional. The helical spring or springs which surround the piston, can be of larger diameter than is conventional, with the result that the spring is more stable and is less likely to exert a lateral force on the piston, due to lateral flexing of the spring. Suitably the exterior diameter of the helical spring in the cylinder is at least 70%, more preferably at least 80% of the internal diameter of the cylinder. It is also thought that direct application of the force of the compression spring to the piston head may reduce lateral forces on the piston head. Consequently, there is less uneven wear of the piston head and the cylinder surface against which it slides. These effects are improved, by the use of two helical springs of opposite helical coiling sense.

In another aspect, the present invention provides an electromagnetic reciprocating compressor having a body, a piston reciprocating in the body and an electromagnetic drive for the piston, the body having front and rear body parts separated from each other by a stack of magnetically permeable laminations providing a stator of the electromagnetic drive, the front and rear body parts and preferably also the lamination stack being located and aligned relative to each other by locating pins received in locating holes in the body parts and passing through the stack of laminations. The locating pins preferably extend axially.

The locating pins may be dowel pins of C-section which are resiliently compressible for insertion in the locating holes.

Preferably the front body part provides a cylinder surface on which a piston head of the piston slides, and the rear body part provides a piston guide surface or surfaces against which a piston guide member of the piston slides. Each of the cylinder surface and the piston guide surface or surfaces is preferably machined to its final size with reference to at least one of the locating holes, so that in the assembled compressor, the cylinder surface and the piston guide surface or surfaces are accurately aligned.

The front and rear body parts may be secured together by bolts.

The invention in this aspect can provide good alignment of the parts of the compressor, particularly front and rear body parts and the lamination stack. The good alignment of the body parts provides accurate alignment of the surfaces on which the piston slides, as described above. Accurate location, in the radial direction, of the lamination stack can allow the air gap between the interior surface of the lamination stack and the exterior surface of an armature on the piston to be small, which leads to higher electrical efficiency and therefore lower power consumption by the compressor. This air gap may be below 0.5mm and even as low as 0.1 mm. As illustrated by the specific embodiment below, the construction provided by this aspect of the invention can allow the front and rear body parts to be made from identical base castings, these base castings being subjected to machining operations to provide the desired final shapes of the front and rear body parts. This simplifies the manufacture of the compressor.

DESCRIPTION OF AN EMBODIMENT

Figure 2:
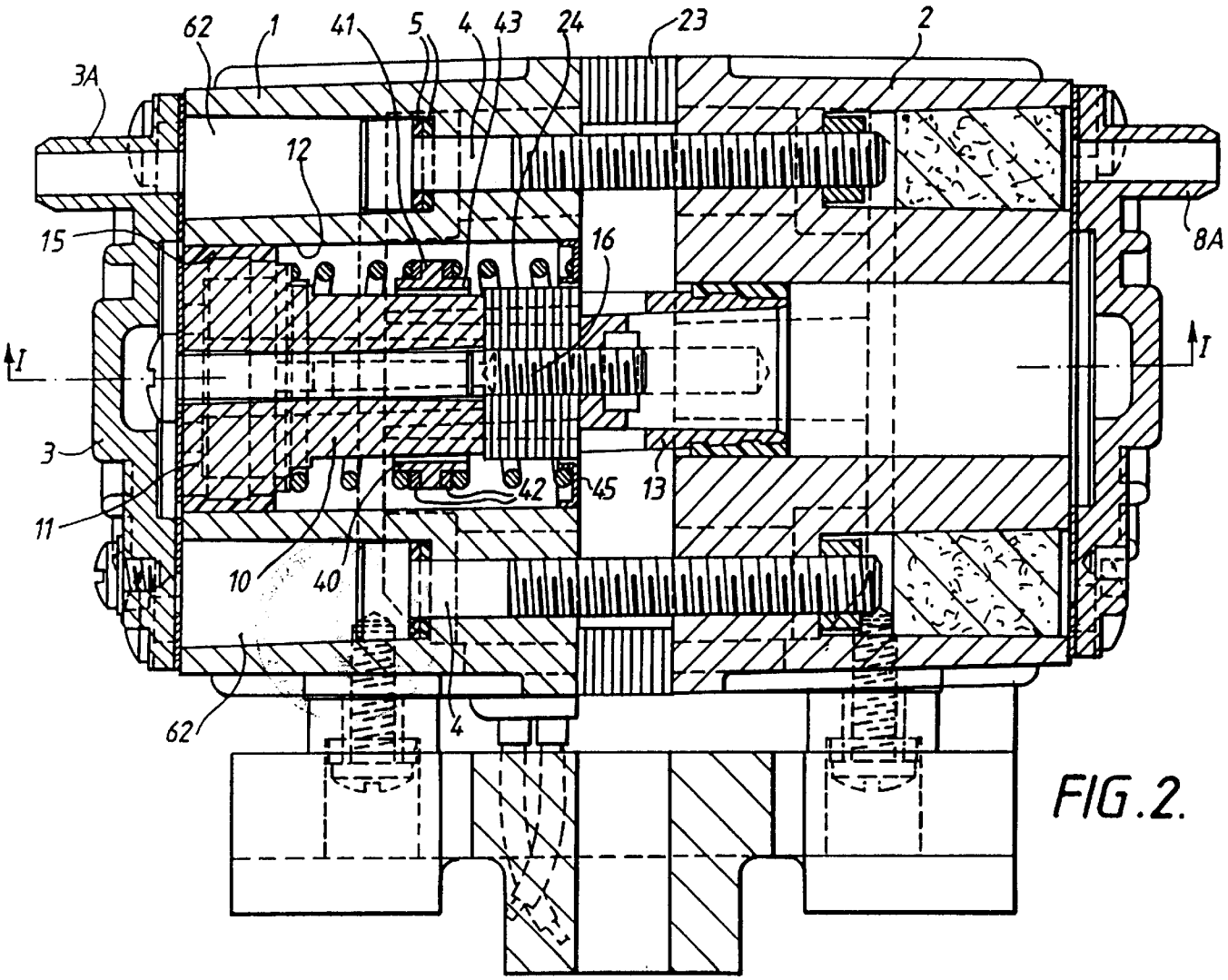

One embodiment of the invention will now be described by way of non-limitative example with reference to the accompanying drawings, in which:

FIG 1 is an axial section of a compressor embodying the invention, on the line I—I of FIG. 2; and FIG. 2 is an axial section of the compressor of FIG. 1, on the line II—II of Fig 1.

The compressor shown in the drawings is generally similar in operation to the compressor shown in the earlier applications, and parts having the same function are given the same reference numerals as in the earlier applications.

The compressor shown in the present drawings has a front body part 1 of square exterior cross-section transverse to the axis and a rear body part 2 also of square exterior cross-section secured together by bolts 4 (see FIG. 2), with electrically insulating washers 5 provided in pairs under the bolt heads, to avoid electrical connection of the body parts 1, 2 to each other. A cylinder head 3 is secured to the front body part, and closes a circumferential recess 62 in the front body part which provides a buffer volume for the air compressed by the compressor to smooth the flow, and connects to an outlet connector 3*a*. Similarly, at the rear end, the rear body part 2 has an end plate 8 which includes an air inlet connector 8*a*. The incoming air passes through a filter 7 in a recess in the rear part body 2 which corresponds in shape to the recess 62 in the front part body, for reasons explained below. The piston head 3 and the end plate 8 are secured to the body parts 1, 2 by bolts (not shown).

Axially reciprocatingly movable within the compressor is a piston 10 having a piston head 11 which has a peripheral continuous band 15 of plastics material moulded onto it and sliding on a cylinder surface 12 provided by the front body part 1. At the rear end of its part providing the piston head 11, the piston 10 has an armature 24, and rearwardly of that a rear piston guide member 13, these parts being secured together by a bolt 16. The front portion 13*a* of the rear piston guide member 13 is in one piece with the cylindrical portion 13*b* which carries at its external periphery a moulded continuous band of low friction plastics material 13*c*, which slides on part-cylindrical piston guide surfaces 14 provided by the rear body part 2. The electromagnetic linear drive of the compressor is provided by the armature 24 together with coils 22 and a stack 23 of magnetically permeable laminations interposed between the body parts 1, 2 and forming a stator. This linear drive is of conventional type and need not be described further, and drives the piston 10 in one direction (to the right in FIGS. 1 and 2). The reverse (compression) stroke of the piston 10 is caused by the spring system 20 described below.

The piston head 11 has air flow passages 30, which may be inclined to the axis of the compressor, as described in the earlier applications, to provide a rotating force to the piston 10 during operation, by turbine effect. These apertures 30 are closed at the face of the piston head 11 by a flexible sheet 31 which provides a flap valve over each aperture 30. Through the wall of the cylinder there is a bore 32 for outflow of compressed air, also closed by a flap valve (not shown) at its outlet end.

The two body parts 1, 2, and also the stator 23, are accurately aligned relative to each other against relative radial displacement, by a pair of dowel pins 50 located at opposite sides of the compressor body and tightly held in opposed blind bores 51 in the body parts 1, 2. The dowel pins 50 have a C-shape in cross-section and are made of spring steel so that they may be easily inserted in the bores 51 but after insertion open to hold tightly in the bores 51 and provide accurate alignment of the two body parts 1, 2 relative to each other. At the same time, the pins 50 pass through holes in the stack 23 of laminations which are approximately the same size as the pins 50, so that the whole of the stack 23 is also accurately radially located. Because of this accurate location of the stack 23 of laminations, the air gap between the interior face of the stack 23 and the armature 24, seen in FIG. 1, can be minimised and may be as small as 0.1 mm.

The body parts 1, 2 are made from identical castings, in aluminium. After casting, the parts are machined to provide the two bores 51 on accurately spaced axes, and thereafter the cylindrical surface 12 of the front body part 1 and the cylindrical surface 14 of the rear body part 1 are formed and machined to the desired diameters and on axes which are accurately located relative to the bores 51. When the body parts 1, 2 and the stack 23 are assembled together by means of the pins 50 and bolts 4, the cylindrical surfaces 12, 14 are very accurately coaxially aligned, so that the piston 10, which is subsequently inserted before fitting of the cylinder head 3, is itself accurately aligned in the compressor. Consequently, wear in the compressor, and in particular uneven wear, which might result from misalignment of the surfaces 12, 14 is minimised.

To avoid a shorted turn in the structure of the compressor, the body parts 1, 2 are electrically isolated from each other. For this purpose, the surfaces of the body parts are anodised, so that there is no electrical connection between them via the pins 50 or through the stack 23.

The spring system 20 providing the return stroke of the piston 10 has two springs 20*a* and 20*b*, which are helical coil springs of mutually opposite direction of coiling, i.e. one of the springs is a right-hand helix and the other is a left-hand helix. Between the opposed ends of these springs is a bearing 40 which is an annular body surrounding the piston 10 with a clearance, so that it is supported only by the springs 20*a*, 20*b* and free to move relative to the piston 10. The bearing 40 provides seats for the ends of the springs 20*a* and 20*b* on rings 42 of low friction material such as PPS (polyphenylene sulphide) blended with a percentage of a lubricating medium and a percentage of reinforcing fibre. These rings 42 lie on opposite sides of a radial flange 41 of the bearing 40 which has a cylindrical sleeve portion 43, which locates the ends of the springs radially. Both springs 20*a*, 20*b* can thus rotate at one end essentially freely relative to the bearing 40 (and relative to the piston and each other) about their central axis. The other end of the spring 20*a* bears on a rear face of the piston head 11 through a flange locating ring 44 which locates the axis of the spring relative to the piston 10. Similarly, the other end of the spring 20*b* is located by a flanged ring 45 which is radially located in the body part 1 as shown in FIG. 2 and abuts axially on the stack 23 of laminations. This end of the spring 20*b* is also radially fixed in this manner.

It can be seen that the spring 20*a* is partly within the cylinder surface 12, during at least part of the stroke of the piston. The exterior diameter of the springs 20*a*, 20*b* is about 85% of the diameter of the cylinder surface 12. The whole of the spring system surrounds the piston 10 between the piston head 11 and the rear piston 13. In this embodiment, the springs 20*a* and 20*b* have a larger diameter than the rear piston 13, to enable assembly of the device and also a larger diameter than the armature 24. Likewise the bearing 40 has a larger diameter than the rear piston 13 and the armature 24.

The ability of the springs 20*a* and 20*b* to rotate freely at one end relative to each other and relative to the piston 10 and the body of the compressor means that they do not tend to exert a rotational torque on the piston and also do not tend to distort laterally, so as to apply lateral force to the piston 10. The springs are of relatively large diameter and therefore are more stable against lateral distortion than narrower diameter springs.

We claim:

1. An electromagnetic reciprocating compressor comprising a body, a piston reciprocating in the body, and an electromagnetic drive for the piston, the piston having a piston head which slides in a cylinder in the body to effect compression of fluid in the cylinder during operation of the compressor and, axially spaced from the piston head, a piston guide member slidingly movable on a piston guide surface provided by the body, the piston carrying an armature forming part of said electromagnetic drive and said body including a lamination stack providing a stator of said electromagnetic drive; and the compressor further comprising a compression spring arrangement comprising at least one helical compression spring acting to drive the piston axially, which said spring is mounted around the piston and is at least partly located within the cylinder during at least part of a piston stroke but is outside a working volume of fluid undergoing compression; and wherein, for replacement or maintenance, the piston including the armature and the piston guide member is removable from the body through an end of the cylinder remote from the piston guide surface, and wherein said spring arrangement is located at one end on a mounting member which bears on said lamination stack providing said stator.

2. A compressor according to claim 1 wherein said compression spring acts at one end upon a face of the piston head which is outside the working volume of fluid undergoing compression.

3. A compressor according to claim 1 wherein said compression spring is freely rotatable at at least one end relative to the piston.

4. A compressor according to claim 1 wherein said compression spring arrangement comprises at least two compression springs mounted around the piston, at least one said spring being at least partly in said cylinder.

5. A compressor according to claim 4 wherein said compression spring arrangement has a pair of helical springs of opposite helical coiling sense acting in series, and a bearing between opposed ends of said pair of helical springs permitting relative rotation of those ends, the bearing being freely movable relative to the piston and the cylinder.

6. An electromagnetic reciprocating compressor comprising a body, a piston reciprocating in an axial direction in the body and an electromagnetic drive for the piston, the body having front and rear body parts separated from each other by a stack of magnetically permeable laminations providing a stator of said electromagnetic drive, the front and rear body parts being located and aligned relative to each other by resiliently compressible locating pins tightly received in locating holes in the body parts and passing through the stack of laminations thereby locating the stack of laminations radially.

7. A compressor according to claim 6 wherein said front body part provides a cylinder surface on which a piston head of the piston slides, and said rear body part provides at least one piston guide surface against which a piston guide member of the piston slides, and each of said cylinder surface and said at least one piston guide surface is machined to its final size with reference to at least one of the locating holes.

8. An electromagnetic reciprocating compressor comprising a body, a piston reciprocating in the body, and an electromagnetic drive for the piston, the piston having a piston head which slides in a cylinder in the body to effect compression of fluid in the cylinder during operation of the compressor and, axially spaced from the piston head, a piston guide surface provided by the body, the piston carrying an armature forming part of said electromagnetic drive;

the compressor further comprising a compression spring arrangement comprising at least two helical compression springs acting to drive the piston axially, which said springs are mounted around the piston and at least one said spring is at least partly located within the cylinder during at least part of a piston stroke but is outside a working volume of fluid undergoing compression; and wherein, for replacement or maintenance, the piston including the armature and the piston guide member is removable from the body through an end of the cylinder remote from the piston guide surface.

9. A compressor according to claim 8 wherein said compression spring arrangement has a pair of helical springs of opposite helical coiling sense acting in series, and a bearing between opposed ends of said pair of helical springs permitting relative rotation of those ends, the bearing being freely movable relative to the piston and the cylinder.

* * * * *

UNITED STATES PATENT AND TRADEMARK OFFICE

CERTIFICATE OF CORRECTION

PATENT NO. : 6,015,273

DATED : January 18, 2000

INVENTOR(S) : Hannagan, et. al.

It is certified that error appears in the above-identified patent and that said Letters Patent is hereby corrected as shown below:

Title page, item [73], Assignee: should read --Pegasus Egerton Limited
Waterlooville, United Kingdom Signed and Sealed this Twenty-seventh Day of June, 2000

*Attest:*

Q. TODD DICKINSON

*Attesting Officer*

*Director of Patents and Trademarks*